US005410785A

United States Patent [19]

Huang

[11] Patent Number: 5,410,785

[45] Date of Patent: May 2, 1995

[54] DEVICE TO DETACHABLY CONNECT TWO OBJECTS

[76] Inventor: Yu-Hwei Huang, No. 5, Alley 2, Lane 85, Min Tsu Road, Lu Chou Hsiang, Taipei Hsien,

[21] Appl. No.: 128,942

[22] Filed: Sep. 29, 1993

[51] Int. Cl.[6] ..... A44B 11/25

[52] U.S. Cl. ..... 24/635; 403/328; 24/706.8

[58] Field of Search ..... 403/327, 328; 24/116 A, 24/635, 634, 706.8

[56] References Cited

U.S. PATENT DOCUMENTS

| | | | |
|---|---|---|---|
| 1,053,883 | 2/1913 | Sheppard | 24/706.8 |
| 2,105,689 | 1/1938 | Freddino | 24/116 A |
| 3,623,194 | 11/1971 | Claeson et al. | 24/635 |
| 3,631,377 | 12/1971 | Ball | 24/635 |
| 3,693,484 | 9/1972 | Sanderson, Jr. | 403/328 |
| 4,195,391 | 4/1980 | Anderson | 24/635 |
| 4,709,454 | 12/1987 | Barnes | 24/635 |
| 4,903,383 | 2/1990 | Gartshore | 24/706.8 |

FOREIGN PATENT DOCUMENTS

| | | | |
|---|---|---|---|
| 2915246 | 10/1979 | Germany | 24/635 |

*Primary Examiner*—Edward K. Look
*Assistant Examiner*—Mark Sgantzos

[57] ABSTRACT

A connector comprised of a hollow cylindrical casing having an annular inside groove; a bushing made to slide in said casing which has a plurality of steel balls respectively inserted in a plurality of radial holes thereof; a lock bolt device inserted into the bushing and locked by the steel ball; a spring element mounted around the bushing within the casing; and a control knob pulled to move the bushing relative to the casing; whereby the lock bolt device can be unlocked and removed from the bushing as the bushing is moved downward by the control knob to compress the spring element, permitting the steel balls to disengage from the lock bolt device and move into the inside annular groove of the casing.

6 Claims, 10 Drawing Sheets

DEVICE TO DETACHABLY CONNECT TWO OBJECTS

BACKGROUND OF THE INVENTION

The present invention relates to a connecting device for connecting two parts together which is comprised of a casing, a bushing, a lock bolt device, a spring element, and a control knob, and which is unlocked simply by pulling the bottom control knob to carry the bushing downward from the casing.

The keys of certain door and cabinet locks can be removed from the respective locks after the locks are locked. However, the key of a motor vehicle can not be removed from the ignition lock when the engine is started. Therefore, the key for the ignition lock of a motor vehicle shall be separately kept. If the key for the ignition lock of a motor vehicle is to be held with other keys by a key ring, a quick detachable connecting device must be used.

SUMMARY OF THE INVENTION

The present invention has been accomplished under the aforesaid circumstances. It is therefore the principal object of the present invention to provide a connector which allows a first object to be quickly detachably connected to a second object. The connector according to the present invention is comprised of a hollow cylindrical casing having an annular inside groove; a bushing made to slide in said casing which has a plurality of steel balls respectively inserted in a plurality of radial holes thereof; a lock bolt device inserted into the bushing and locked by the steel ball; a spring element mounted around the bushing within the casing; and a control knob pulled to move the bushing relative to the casing. The lock bolt device can be unlocked and removed from the bushing as the bushing is moved downward by the control knob to compress the spring element, for permitting the steel balls to disengage from the lock bolt device and move into the inside annular groove of the casing.

DETAILED DESCRIPTION OF THE PREFERRED EMBODIMENTS

Figure 1:
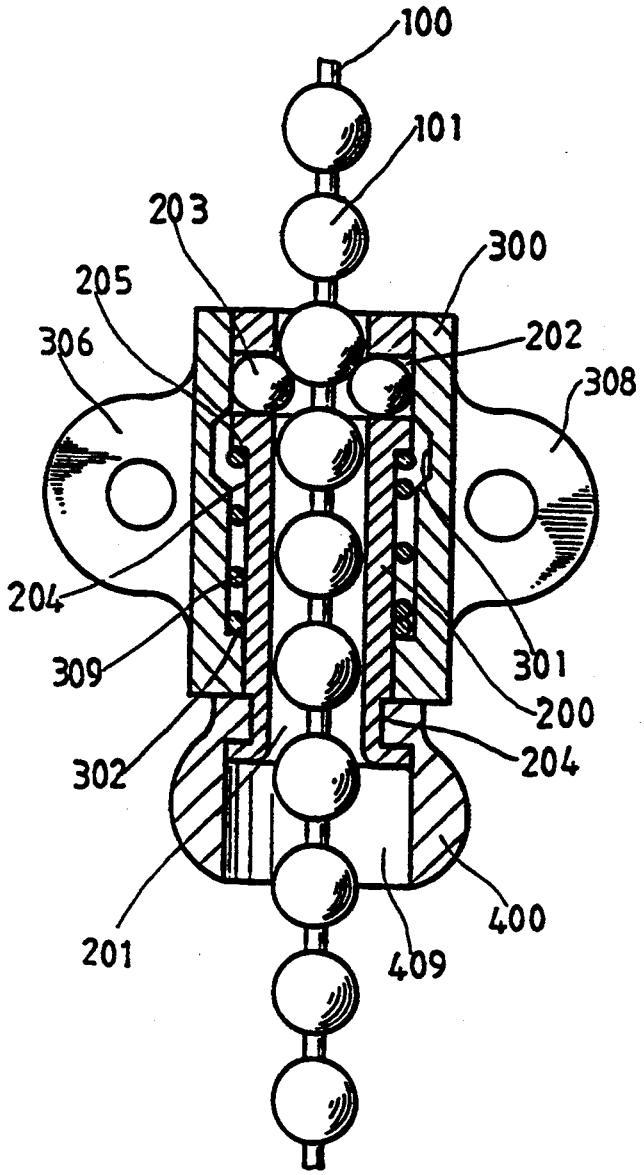
FIG. 1 is a longitudinal view in section of a connector according to one embodiment of the present invention.
Figure 2:
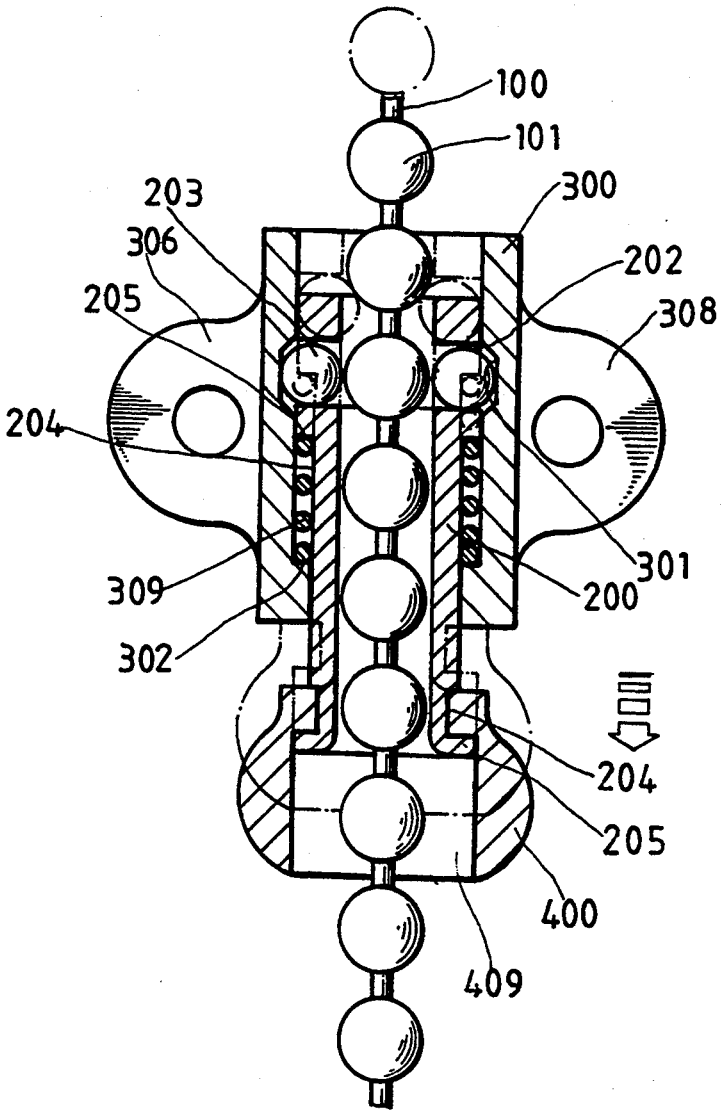
FIG. 2 is similar to FIG. 1 but showing the bushing thereof moved from the locked position to the unlocked position to relate the lock bolt device.

Referring to FIGS. 1 and 2, a lock bolt device 100 which is formed of a string of beads 101 is inserted through the central through hole 201 of a bushing 200 being fastened within a cylindrical casing 300. The cylindrical casing 300 has mounting tabs 306;308 for fastening to an object. The bushing 200 comprises a plurality of radial holes 202 around the central through hole 201, which receive a respective steel ball 203 each. The diameter of the beads 101 is slightly smaller than the diameter of the central through hole 201. The steel balls 203 are made in such a size that they partially project into the central through hole 201 as the connector is locked (See FIG. 1). The bushing 200 further comprises a neck portion 204 near a bottom end thereof, and an outward flange 205 on the outside around the periphery at a suitable elevation. A control knob 400 is mounted around the neck portion 204 of the bushing 200, having a central through hole 409 longitudinally aligned with the central through hole 201 of the bushing 200, through which the lock bolt device 100 passes. The casing 300 comprises an inside annular groove 301 around the inside wall near a top end thereof, and an inward flange 302 projected from a bottom end thereof. A spring element 309 is mounted around the bushing 200 within the casing 300 and stopped between the outward flange 205 of the bushing 200 and the inward flange 302 of the casing 300.

Referring to FIGS. 1 and 2 again, pulling the control knob 400 downward from the casing 300 causes the bushing 200 moved longitudinally relative to the casing 300. As the radial holes 202 on the bushing 200 are horizontally communicated with the inside annular groove 301 on the casing 300, the lock bolt device 100 is unlocked and can be moved through the central through hole 201 on the bushing 200 and the central through hole 409 on the control knob 400, and therefore the connector is unlocked. On the contrary, as the control knob 400 is released from the hand, the spring element 309 immediately pushes the bushing 200 and the control knob 400 back to their former positions, causing the steel balls 203 to engage into the gap between either two beads 101 of the lock bolt device 100, and therefore the lock bolt device 100 is locked in position. If the lock bolt device 100 is pulled downward, the bushing 200 will be simultaneously carried downward. As soon as the radial holes 202 are disposed in the same elevation with the the inside annular groove 301, the steel balls 203 are disengaged from the beads 201 for permitting the lock bolt device 100 to be moved relative to the bushing 200. When released, the spring element 309 will immediately push the bushing 200 back to its former position, causing the steel balls 203 to stop the lock bolt device 100 from moving in the axial direction.

Figure 3:
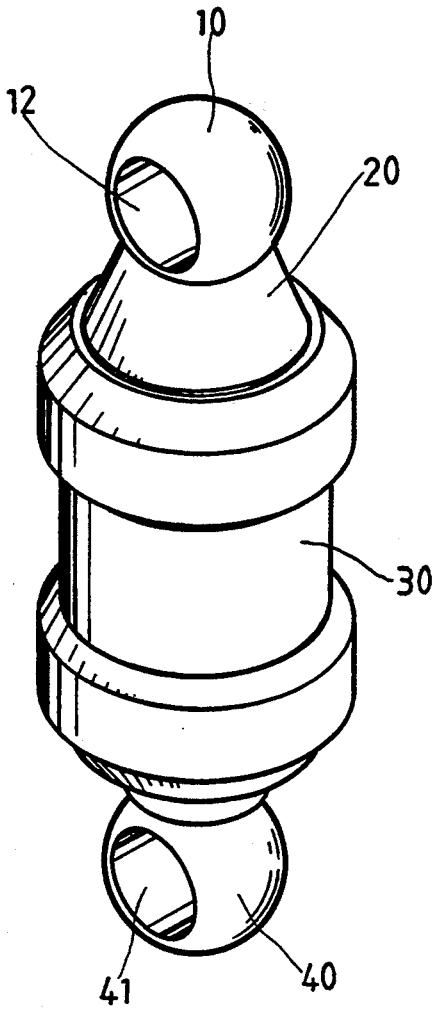
FIG. 3 is an elevational view of a connector according to another embodiment of the present invention.
Figure 4:
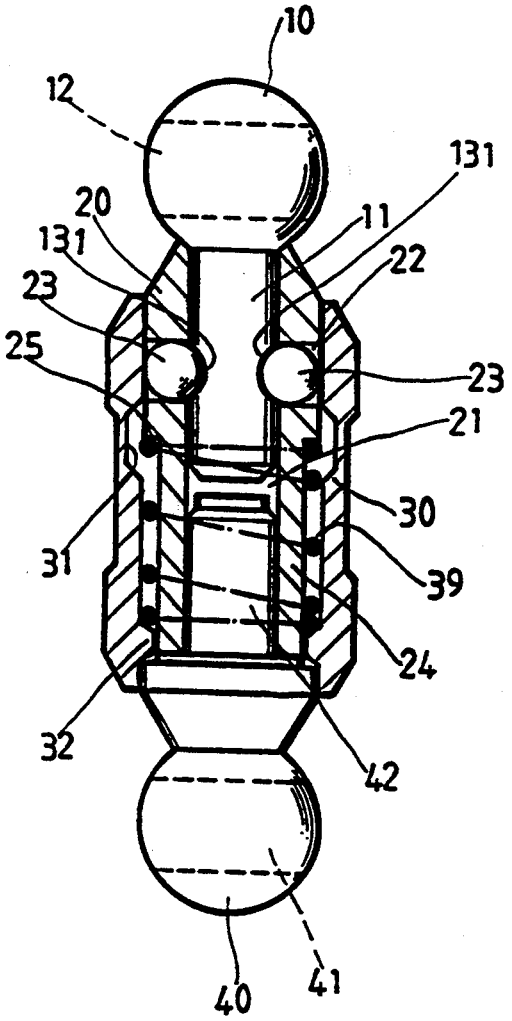
FIG. 4 is a longitudinal view in section of the connector of FIG. 3.
Figure 5:
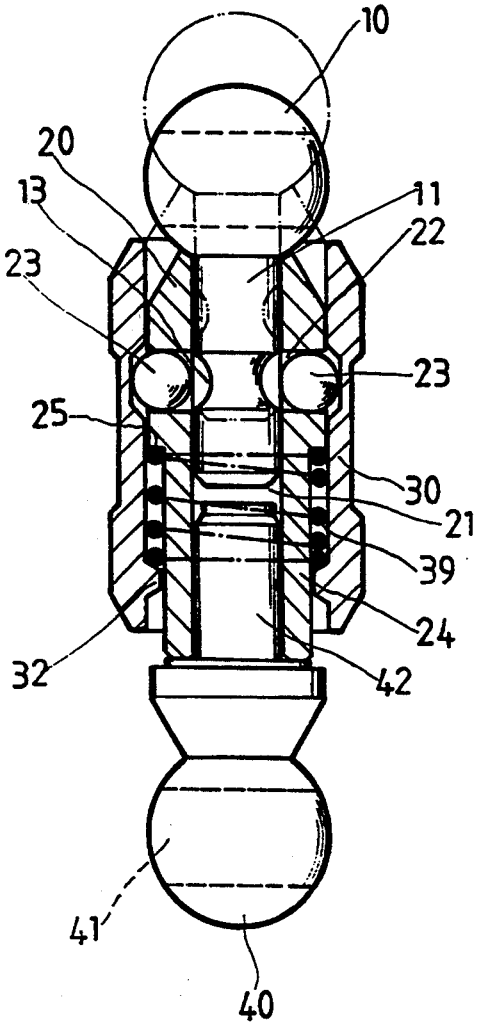
FIG. 5 is similar to FIG. 4 but showing the bushing thereof moved from the locked position to the unlocked position.
Figure 6:
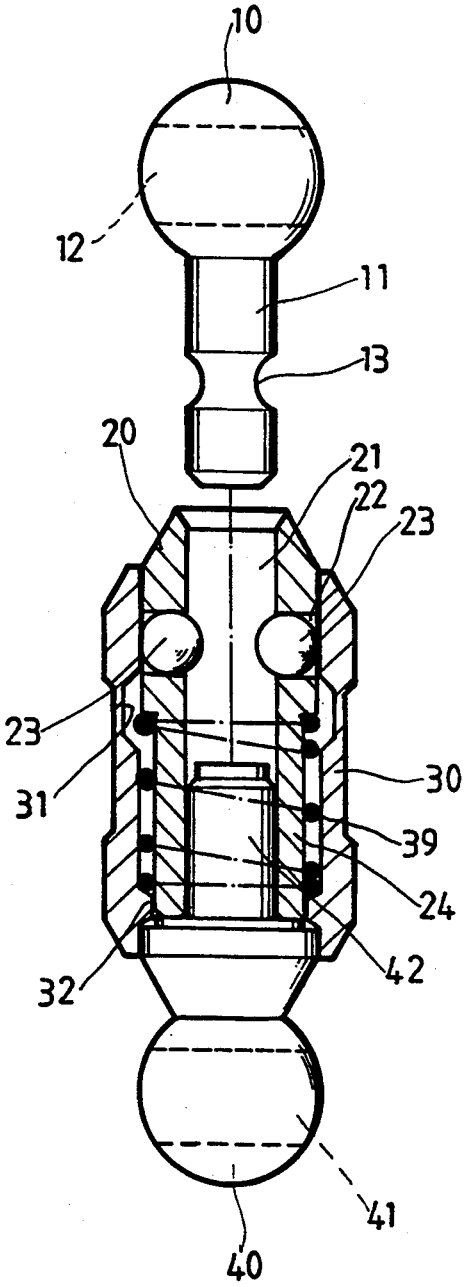
FIG. 6 shows the lock bolt device of the connector of FIG. 3 removed from the bushing.

Referring to FIGS. 3 and 4, therein illustrated is an alternate form of the present invention. A lock bolt device 10 is made in the shape of a headed bolt comprising an elongated bolt body 11 inserted into the central through hole 21 of a bushing 20 being received within a cylindrical casing 30, and a radial through hole 12 through the head thereof. The bolt body 11 of the lock bolt device 10 comprises a neck portion 131. The bushing 20 comprises a plurality of radial holes 22 which each receive a steel ball 23, the holes 22 being disposed around a circle corresponding to the neck portion 131 on the bolt body 11 of the lock bolt device 10, which receive a steel ball 23 each, a reduced outer diameter 24, and an outward flange 25 around the outside wall between the reduced outer diameter 24 and the radial holes 22. A spring element 39 is mounted around the lower segment with the reduced outer diameter 24 within the casing 30 and disposed between the outward flange 25 of the bushing 20 and an inward flange 32 on the casing 30. The casing 30 further comprises an annular groove 31 around the inside wall spaced above the inward flange 32. A control knob 40 is fastened to the bushing 20. The control knob 40 is made in the form of a headed bolt having an elongated body 42 fixed within the central through hole 21 of the bushing 20, and a radial through hole 41 through the head thereof. As illustrated in FIG. 4, the steel balls 23 engage into the neck portion 13 to lock the lock bolt device 10 in position. As the control knob 40 is pulled downward (see FIG. 3, the bushing 20 is simultaneously moved downward to compress the spring element 39. As soon as the steel balls 23 were moved to the elevation of the inside annular groove 31 on the casing 30, they become disengaged from the neck portion 13 of the lock bolt device 10 (see FIG. 5), and therefore the lock bolt device 10 can then be removed from the bushing 20 (see FIG. 6).

Figure 7:
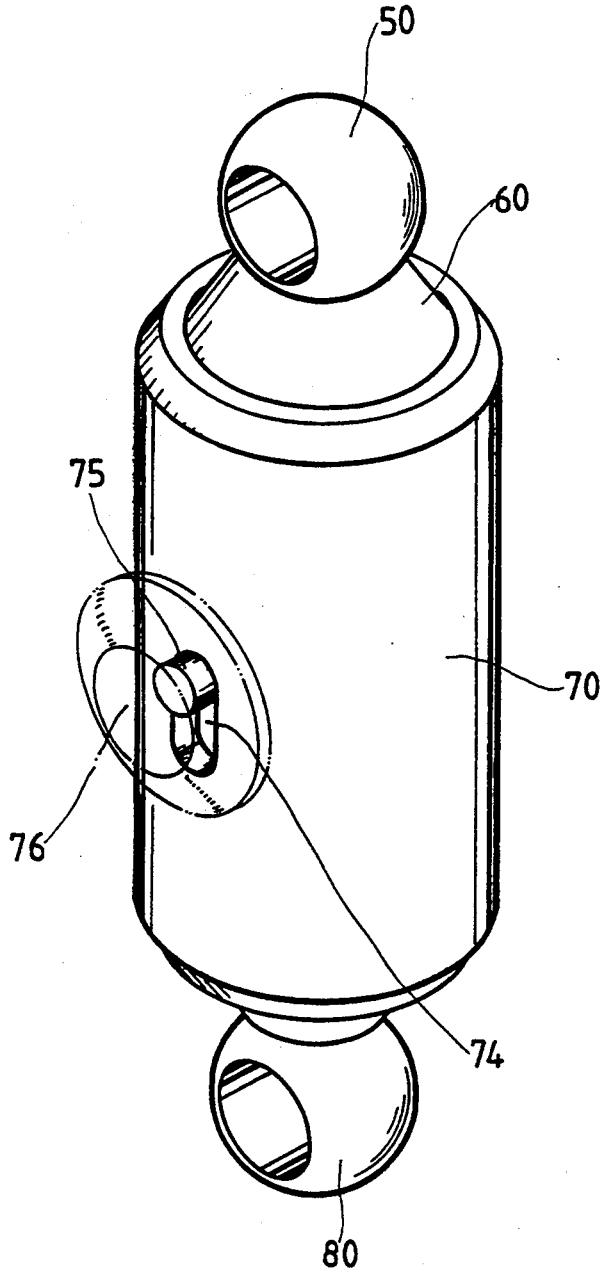
FIG. 7 is an elevational view of a connector according to still another embodiment of the present invention.
Figure 8:
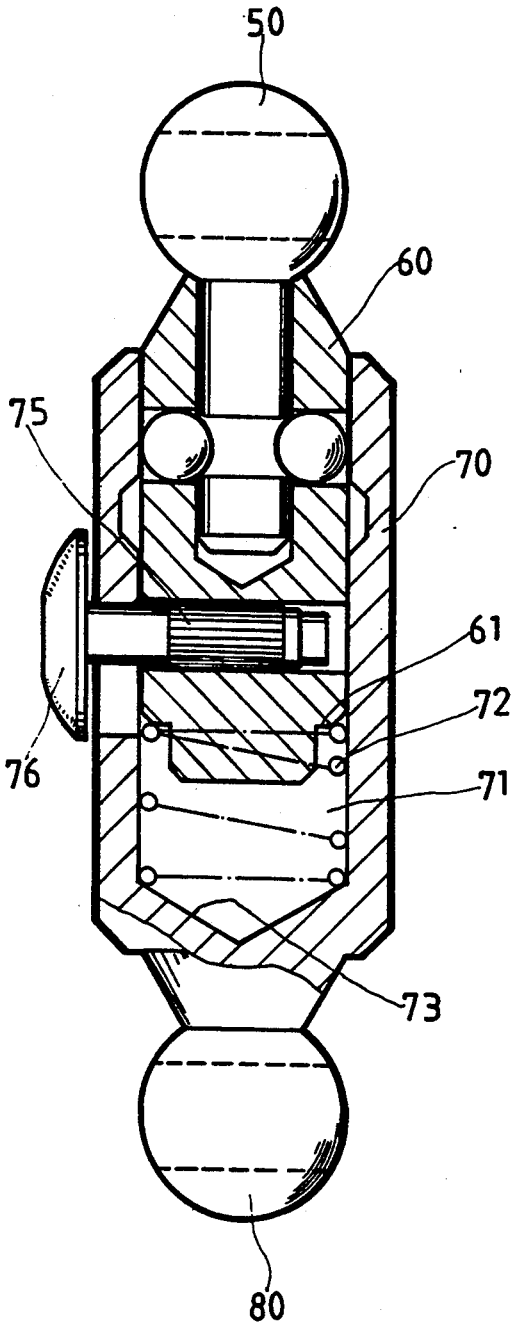
FIG. 8 is a longitudinal view in section of the connector of FIG. 7.
Figure 9:
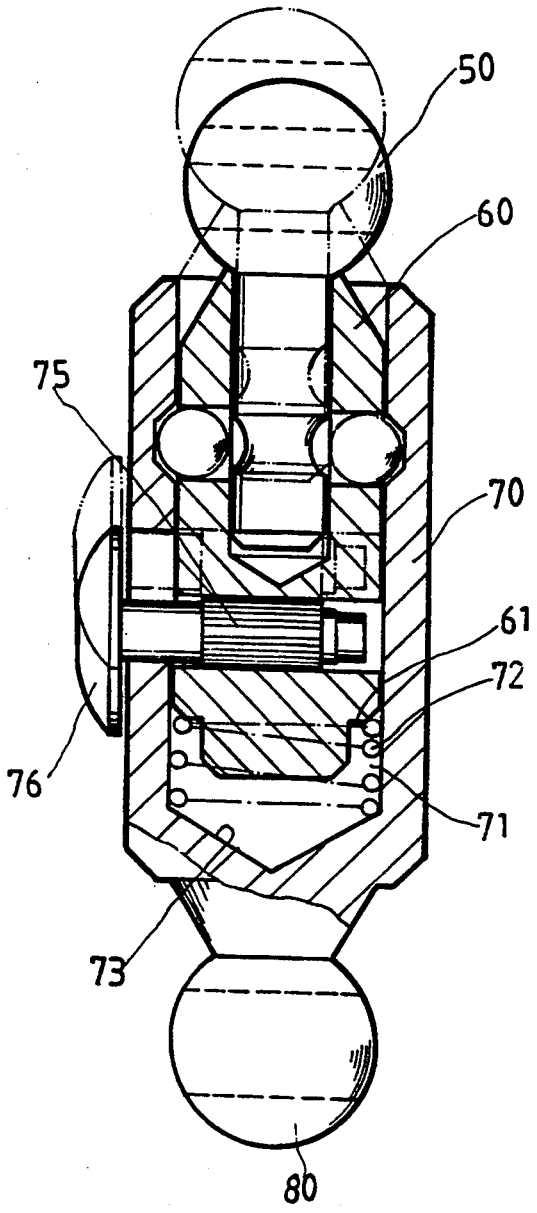
FIG. 9 is similar to FIG. 8 but showing the bushing thereof moved from the locked position to the unlocked position.
Figure 10:
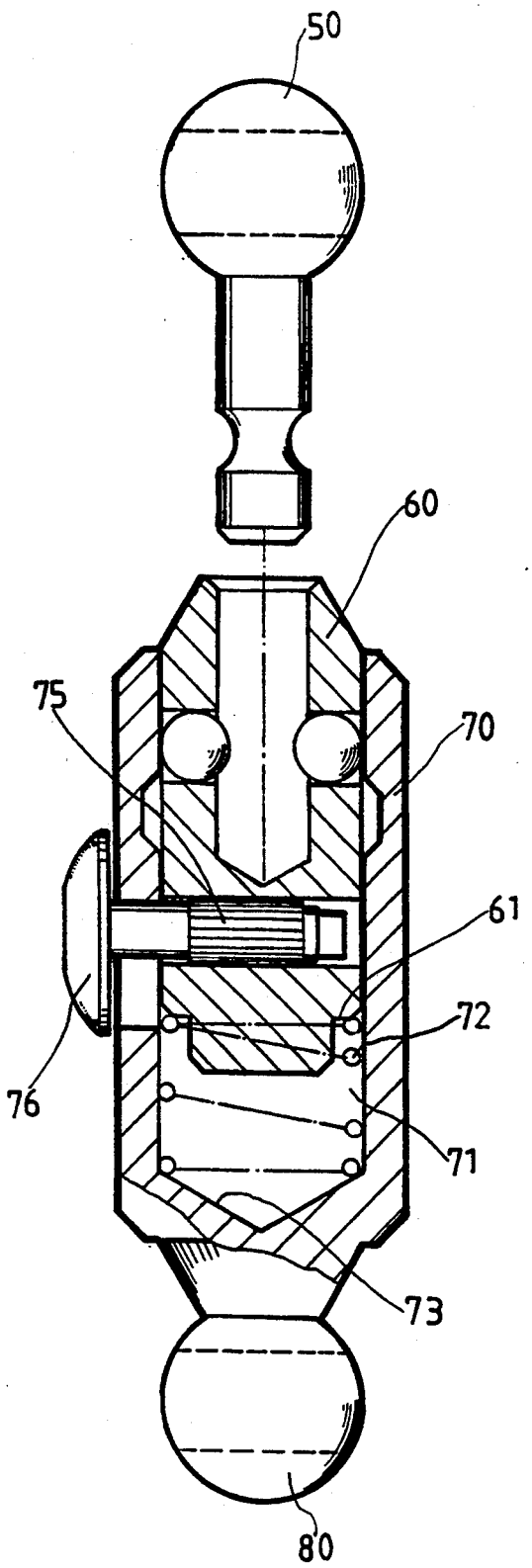
FIG. 10 shows the lock bolt device of the connector of FIG. 6 removed from the bushing.

Referring to FIGS. 7 and 8, the connector is also comprised of a lock bolt device 50, a bushing 60, a cylindrical casing 70, and a control knob 80. The lock bolt device 50 and the busing 60 are similar to the corresponding parts in the embodiment shown in FIGS. 3, 4, 5, and 6. The control knob 80 and the cylindrical casing 70 are integrally fabricated together, defining an inside hole 71. The cylindrical casing 70 comprises an oblong hole 74 longitudinally disposed through the periphery. There is a lever 75 having one end inserted through the oblong hole 74 and fastened to the bushing 60, and an opposite end coupled with a knob 76 disposed outside the casing 70. As the knob 76 is moved vertically along the oblong hole 74, the bushing 60 is moved relative to the casing 70, and therefore the lock bolt device 50 is locked or unlocked (see FIGS. 9 and 10).

What is claimed is:

1. A connector comprising:

a casing, said casing comprising a central through hole, an annular inside groove around the central through hole of said casing;

a bushing made to slide in the central through hole of said casing, said bushing comprising a central through hole and a plurality of radial through holes around the central through hole of said bushing;

a lock bolt device inserted into the central through hole of said bushing;

steel balls respectively inserted in the radial through holes on said bushing and engaged with said lock bolt device to lock said lock bolt device in place;

a spring element disposed around said bushing within said casing; and a control knob pulled to move said bushing;

whereby said lock bolt device is unlocked and removed from said bushing as said bushing compresses said spring element as the control knob is pulled, the bushing moving away from form said radial through holes and thereby permitting said steel balls to disengage from said lock bolt device and move into the annular inside groove of said casing.

2. The connector of claim 1 wherein said lock bolt device is comprised of a string of beads, the diameter of said beads being slightly smaller than the diameter of the central through hole of said bushing.

3. The connector of claim 1 wherein:

said bushing comprises a lower segment with an outer diameter that is smaller than that of an upper segment of said bushing, and an outward flange around a top end of said bushing; said casing comprises an inward bottom flange; said spring element is fastened around the lower segment of said bushing and retained between the outward flange of said bushing and the inward flange of said casing.

4. The connector of claim 3 wherein said reduced outer diameter of said bushing comprises a neck portion near a bottom end thereof onto which said control knob is fastened.

5. The connector of claim 1 wherein said control knob has one end fixed within the central through hole of said bushing and moved to slide said bushing in the central through hole of said casing.

6. The connector of claim 1 wherein said casing comprises an oblong through hole longitudinally disposed through the periphery, and a lever having one end inserted through the oblong through hole of said casing and fastened to said bushing and an opposite end extended out of said casing and coupled with a knob for moving said bushing longitudinally relative to said casing.

* * * * *